US008689579B2

(12) United States Patent
Yoshitake et al.

(10) Patent No.: US 8,689,579 B2
(45) Date of Patent: Apr. 8, 2014

(54) INDOOR UNIT OF AIR CONDITIONER

(75) Inventors: Nobusato Yoshitake, Fuji (JP); Kenji Gajina, Fuji (JP); Kazuo Mochizuki, Fuji (JP); Yousuke Komatsu, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 515 days.

(21) Appl. No.: 12/718,745

(22) Filed: Mar. 5, 2010

(65) Prior Publication Data

US 2010/0192610 A1 Aug. 5, 2010

Related U.S. Application Data

(63) Continuation of application No. PCT/JP2008/066188, filed on Sep. 8, 2008.

(30) Foreign Application Priority Data

Sep. 7, 2007 (JP) ..... 2007-233041
Oct. 24, 2007 (JP) ..... 2007-276673

(51) Int. Cl.
*F25D 17/04* (2006.01)

(52) U.S. Cl.
USPC ..... 62/407; 62/291; 62/418; 62/DIG. 16

(58) Field of Classification Search
USPC ..... 62/407, 418, DIG. 16, 285, 288, 291
See application file for complete search history.

(56) References Cited

U.S. PATENT DOCUMENTS

| | | | | |
|---|---|---|---|---|
| 1,993,534 | A * | 3/1935 | Stoltz | 251/216 |
| 3,990,855 | A * | 11/1976 | Cort et al. | 422/264 |
| 4,146,207 | A * | 3/1979 | Rofe | 251/120 |
| 7,032,253 | B2 * | 4/2006 | Colpitts et al. | 4/287 |

FOREIGN PATENT DOCUMENTS

| | | |
|---|---|---|
| CN | 1556766 | 12/2004 |
| JP | 61-15416 | 1/1986 |
| JP | 62-91115 | 6/1987 |
| JP | 07-018128 | 3/1995 |
| JP | 2002-276985 | 9/2002 |
| JP | 2002-276987 | 9/2002 |
| JP | 2007-024454 | 2/2007 |
| JP | 2007-85690 | 4/2007 |
| JP | 2007-085690 | 4/2007 |
| WO | WO 94/20735 | 9/1994 |

OTHER PUBLICATIONS

International Preliminary Report on Patentability (IPRP) issued in PCT/JP20081065188 on Mar. 30, 2010.
English Abstract of JP 2007-085690 published Mar. 31, 2005.

(Continued)

*Primary Examiner* — Cheryl J Tyler
*Assistant Examiner* — Orlando E Aviles Bosques
(74) *Attorney, Agent, or Firm* — DLA Piper LLP (US)

(57) ABSTRACT

An indoor unit of an air conditioner includes a heat exchanger accommodated inside a indoor unit body which is a housing whose lower face is opened, a drain pan which is disposed below the heat exchanger and receives drain water generated at the heat exchanger, a drain pump which is detachably disposed within the indoor unit body, sucks drain water accumulated in the drain pan and discharges the drain water to the outside, a drain port which is disposed at a bottom face wall section of the drain pan, the port being an opening portion through which the drain pump is insertable, and a drain cap which openably closes the drain pump insertion port.

3 Claims, 7 Drawing Sheets

(56) References Cited

OTHER PUBLICATIONS

English Translation of JP 2007-085690 published Mar. 31, 2005.
International Search Report issued in PCT/JP08/066188 on Nov. 25, 2008.
Japanese Office Action issued in JP 2009-531306 mailed on Dec. 20, 2011.
English Language Translation of Japanese Office Action issued in JP 2009-531306 mailed on Dec. 20, 2011.
English Language Abstract of JP 2002-276985 published on Sep. 25, 2002.
English Language Translation of JP 2002-276985 published on Sep. 25, 2002.
English Language Abstract of JP2002-276987 published on Sep. 25, 2002.
English Language Translation of JP2002-276987 published on Sep. 25, 2002.
English Language Abstract of JP 07-018128 published on Jan. 20, 1995.
English Language Translation of JP 07-01128 published on Jan. 20, 1995.
English Language Abstract of JP 2007-024454 published on Feb. 1, 2007.
English Language Translation of JP 2007-024454 published on Feb. 1, 2007.
English Language Abstract of JP 2007-085690 published on Apr. 5, 2007
English Language Translation of JP 2007-085690 published on Apr. 5, 2007.
Chinese Office Action issued in 200880105665.1 mailed on May 20, 2013.
English Language Translation of Chinese Office Action issued in 200880105665.1 mailed on May 20, 2013.
Chinese Office Action issued in CN 200880105665.1 dated Nov. 25, 2013.
English Language Translation of Chinese Office Action issued in CN 200880105665.1 dated Nov. 25, 2013.
English Language Abstract of CN1556766 published Dec. 22, 2004.

* cited by examiner

INDOOR UNIT OF AIR CONDITIONER

CROSS-REFERENCE TO RELATED APPLICATIONS

This is a Continuation Application of PCT Application No. PCT/JP2008/066188, filed Sep. 8, 2008, which was published under PCT Article 21(2) in Japanese.

This application is based upon and claims the benefit of priority from prior Japanese Patent Applications No. 2007-233041, filed Sep. 7, 2007; and No. 2007-276673, filed Oct. 24, 2007, the entire contents of both of which are incorporated herein by reference.

BACKGROUND OF THE INVENTION

1. Field of the Invention

The present invention relates to an indoor unit of an air conditioner which is, for example, ceiling-embedded, and in particular, relates to improvement of the structure for attaching a drain pump.

2. Description of the Related Art

An indoor unit of a ceiling-embedded air conditioner comprises an indoor unit body which is located at a ceiling. The indoor unit body comprises, at the inside thereof, a blower, a heat exchanger, a drain pan which receives drain water generated at the heat exchanger during cooling, a drain pump to discharge drain water accumulated in the drain pan via a drain hose to the outside, and the like.

Regarding the drain pan, it is necessary to forcibly discharge to the outside drain water accumulated at the drain pan when the drain hose is clogged or the drain pump is out of order. Further, the drain pan receives maintenance operation such as eliminating scale-like material which is generated and accumulated within the drain pan due to a long-term use. Accordingly, the drain pan is provided with a drain port.

For example, in Jpn. Pat. Appln. KOKAI Publication No. 2007-85690, a drain cap which seals a drain port is configured to be water-tightly fixed while being detachably attachable to the drain port. Further, a discharge hole is provided approximately at the center part of the drain cap and to dispose a discharge plug can be water-tightly fixed to the discharge hole while being detachably attachable.

According to Jpn. Pat. Appln. KOKAI Publication No. 2007-85690, at the time of maintenance such as eliminating slime in the drain pan, the drain cap is removed from the drain port which has a large diameter, so that operability is improved. When discharging drain water from the drain pan, only the discharge hole is opened by removing the discharge plug. It is described that discharging of a large amount of drain water at a stroke can be prevented because the discharge hole is formed to have a small diameter.

BRIEF SUMMARY OF THE INVENTION

However, when the drain pan is being cleaned, it is also desirable to service the drain pump. The drain pump is detached by removing a decorative panel, an electric part box and the drain pan. Therefore, the maintenance operation for the drain pump takes an extremely long time.

Further, the discharge plug fitted to the discharge hole has a small diameter. Then, in order to reliably seal the discharge hole, the discharge plug must be water-tightly fixed as being detachably attachable. Although not described particularly, the discharge plug can be a rubber cap. However, in this case, large force is required to attach and detach the cap.

In common sense, a solution for moisture condensation is required for the drain cap. Specifically, a heat insulating material is applied to a drain cap surface. However, in the case of applying the heat insulating material, in addition to much expense in time, there is a fear of peeling due to long-term usage. The drain pump is located at the secondary side where heat exchange air is introduced from the heat exchanger. Accordingly, the heat exchanger requires processing of being bent while avoiding the drain pump, which is difficult.

To address the above-mentioned issues, the present invention provides an indoor unit of an air conditioner which contributes to work time reduction due to elimination of special processing for a heat exchanger while simplifying maintenance for a drain pump.

In order to achieve the above-described object, there is provided an indoor unit of an air conditioner, comprising: an indoor unit body which is a housing whose lower face is opened; a heat exchanger accommodated inside the indoor unit body; a drain pan which is disposed below the heat exchanger and receives drain water generated at the heat exchanger; a drain pump which is detachably disposed within the indoor unit body, sucks drain water accumulated in the drain pan and discharges the drain water to the outside; a drain pump insertion port which is disposed at a bottom face wall section of the drain pan, the port being an opening portion through which the drain pump is insertable; and a closing member which openably closes the drain pump insertion port.

In order to achieve the above-described object, there is provided an indoor unit of an air conditioner, comprising: an indoor unit body which is a housing whose lower face is opened; a blower which sucks air from an axis direction and blows the air in a circumferential direction, the blower being arranged to be opposed to an approximately center part of the bottom face opening portion, a heat exchanger which is arranged to surround circumference of a blowing side of the blower, and a drain pan which is disposed below the heat exchanger and receives drain water generated at the heat exchanger, the blower, the heat exchanger and the drain pan being accommodated inside the indoor unit body; a decorative panel which closes the lower face opening portion of the indoor unit body and comprises an intake port being opposed to the blower and the inside of the heat exchanger and a blowing port being opposed to a space between an outer portion of the heat exchanger and a side wall of the indoor unit body; a drain pump which sucks drain water accumulated in the drain pan and discharges the drain water to the outside, the drain pump being arranged at a projecting portion of at least a part of the drain pan projecting to be opposed to the intake port of the decorative panel; a drain pump insertion port opened to have a diameter so that the drain pump is insertable, the drain pump insertion port being arranged at a drain pan bottom face wall section right below the drain pump; and a closing member which openably closes the drain pump insertion port.

DETAILED DESCRIPTION OF THE INVENTION

In the following, embodiments of the present invention will be described with reference to the drawings.

Figure 1:
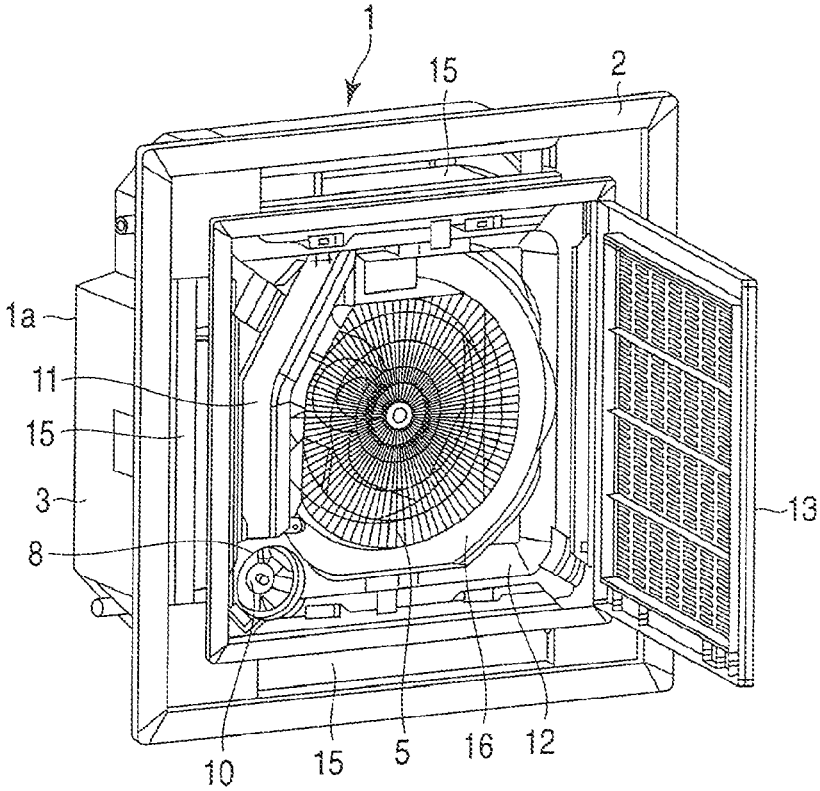
FIG. 1 is a perspective view of an indoor unit of an air conditioner as viewed from below according to an embodiment of the present invention.

FIG. 1 is a perspective view of an indoor unit of a ceiling-embedded air conditioner as viewed from below according to an embodiment of the present invention.

Figure 2:
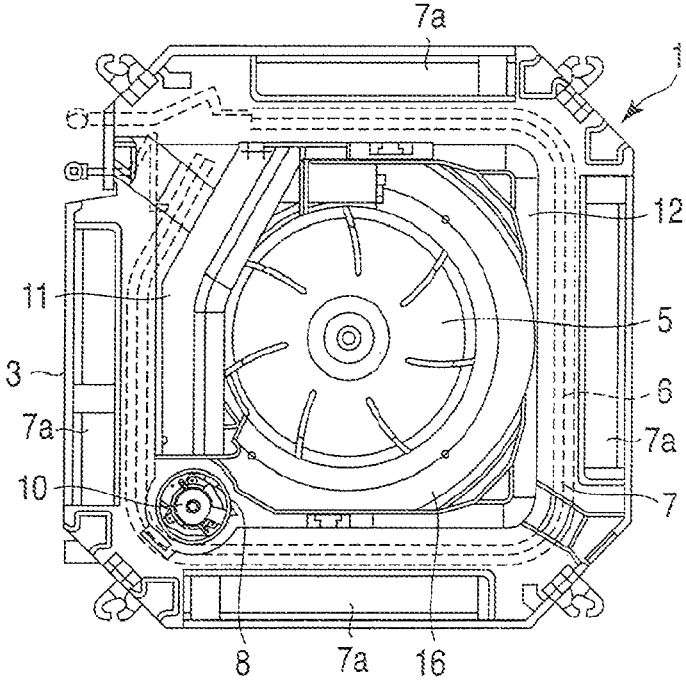
FIG. 2 is a bottom view of an indoor unit body from which a decorative panel is detached, according to the present embodiment.
Figure 3:
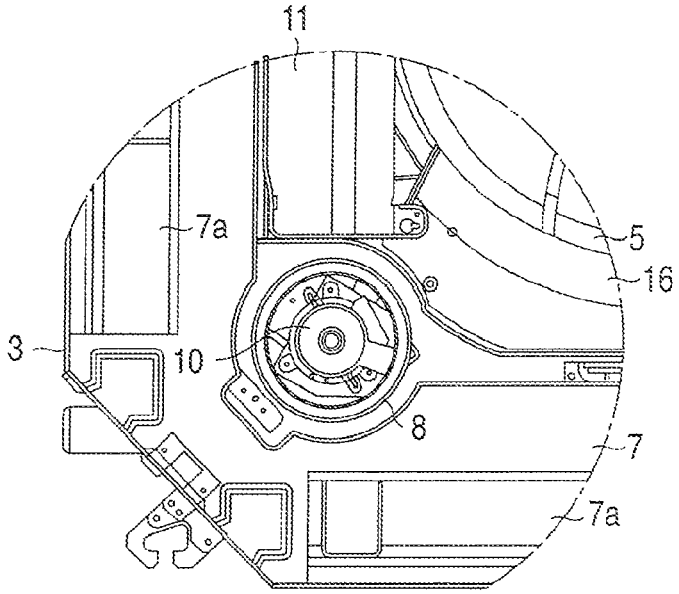
FIG. 3 is a partially enlarged view of a bottom face of the indoor unit body according to the present embodiment.

FIG. 2 is a bottom view of the indoor unit body. FIG. 3 is a partially enlarged view of a bottom face of the indoor unit.

The indoor unit of an air conditioner comprises an indoor unit body 1 and a decorative panel 2. The indoor unit body 1 is inserted in an opening in a ceiling board from inside a room and is fixed to a back side of the ceiling via a hanging bolt and the like. The decorative panel 2 is attached to a lower face section of the indoor unit body 1 and is exposed to the room side from the ceiling.

The indoor unit body 1 comprises a plate-made casing 3 obtained by processing a metal thin plate for a top plate section and side face sections while a lower face section is opened. A heat insulating material made of formed polystyrene and the like is attached to an inner circumferential face of the casing 3, so that the entire inner circumferential face is covered with the heat insulating material. In this manner, the indoor unit body 1 has a heat-insulated structure.

A blower 5 protected by a fan guard is disposed at an approximately center part of the lower face opening portion of the indoor unit body 1. The blower 5 comprises a so-called centrifugal fan which sucks air from an axis direction and blows the air in a circumferential direction. Here, the centrifugal fan is also called a turbo fan. The indoor unit body 1 is provided with a portion 1*a* above the ceiling and the blower 5 and has an opening portion at a lower part. Accordingly, the lower face opening portion of the indoor unit body 1 is located at an intake side of the blower 5.

A heat exchanger 6 which is shaped as an approximately rectangular frame in a plane view is disposed to surround a periphery of the blower 5. A drain pan 7 is located at a lower part than the heat exchanger 6.

The drain pan 7 is configured to receive drain water generated along with heat exchange action of the heat exchanger 6 during cooling operation. The drain pan 7 is fitted to a side wall of the indoor unit body 1. The drain pan 7 comprises a concave portion 7*a* which is concavely formed inward at an outer side portion thereof. Further, only one inner corner portion of the drain pan 7 is formed to be projected inward, and then, a drain pump insertion port 8 is formed at the bottom face wall of the drain pan 7 at the projecting portion.

As described later, the drain pump insertion port 8 also serves as an opening portion to remove drain water, scale-like material and the like (hereinafter, collectively called "drain water") remaining in the drain pan 7. Hereinafter, the drain pump insertion port 8 is called "the drain port 8".

The drain port 8 is closed with a drain cap 18, which is a later-mentioned closing member, while being capable of opening and closing. FIGS. 1 and 2 illustrate states that the drain cap 18 is removed from the drain port 8. FIG. 3 illustrates the drain port 8 and the periphery thereof after the drain cap 18 is removed from the drain port 8 of FIG. 2 in an enlarged manner.

In particular, as illustrated in FIG. 3, a later-mentioned drain pump 10 can be seen through the opened drain port 8. That is, the drain pump 10 is located at a part right above the drain port 8. In other words, the drain port 8 is located at a part right below the drain pump 10 and attached so that the center axis of the drain pump 10 and the center axis of the drain port 8 are matched.

In addition, the diameter of the drain port 8 is larger than the diameter of the drain pump 10, so that the outer circumferential face of the drain pump 10 can be completely seen through the drain port 8. Accordingly, after removing the drain pump 10, the drain pump 10 can be passed through the drain port 8. This is why the drain port 8 is called "the drain pump insertion port 8".

An electric part box 11 is disposed in the vicinity of the drain port 8 along a part of the inside of the drain pan 7. The electric part box 11 is configured to accommodate electric parts which control electrically-driven components accommodated in the indoor unit body 1, electric parts which perform transmission/reception for remote control, and the like.

The lower opening portion of the casing 3 is closed with the decorative panel 2 which is illustrated only in FIG. 1. The decorative panel 2 is molded of synthetic resin material and is beautifully finished. The decorative panel 2 is exposed to the room from the ceiling board and closes the clearance between the circumferential face of the indoor unit body 1 and the opening portion for mounting of the ceiling board.

An intake port 12 is opened at an approximately center part of the decorative panel 2. The intake port 12 of the decorative panel 2 is capable of being opened and closed with an intake grille 13 comprising a filter. FIG. 1 illustrates a state that the intake port 12 is exposed by opening the intake grille 13. FIG. 2 illustrates a state that the decorative panel 2 is removed from the indoor unit body 1.

In further description, the intake port 12 is opened at a part opposed to the blower 5 and an inner section of the heat exchanger 6 and is formed to be approximately rectangular. The intake grille 13 detachably is attached to the intake port 12.

The intake grille 13 insulates the inside of the casing 3 from the intake port 12 while enabling circulation of room air through the intake port 12. At the time of maintenance, the filter can be detached by opening the intake grille 13, so that cleaning the filter can be performed on a floor of the room.

Since the drain port 8 formed at the drain pan 7 is disposed at one corner portion of the drain pan 7, the drain port 8 is located at a part opposed to the intake port 12. Further, a blowing port 15 is formed along each side portion of the decorative panel 2. The blowing ports 15 are opposed to the clearance formed between the side face wall of the indoor unit body 1 and the concave portion 7*a* of the drain pan 7.

A bell mouth 16 is disposed between the decorative panel 2 and the blower 5. The drain pan 7 surrounds the periphery of the bell mouth 16. The bell mouth 16 is formed to be horn-shaped having a small diameter at the blower 5 side and a large diameter at the intake port 12 side of the decorative panel 2. Although a part thereof is closed against the intake port 12 by the electric part box 11, the bell mouth 16 maintains a function of blowing air guidance.

Next, the configuration of attaching the drain pump 10 will be described in detail.

Figure 4:
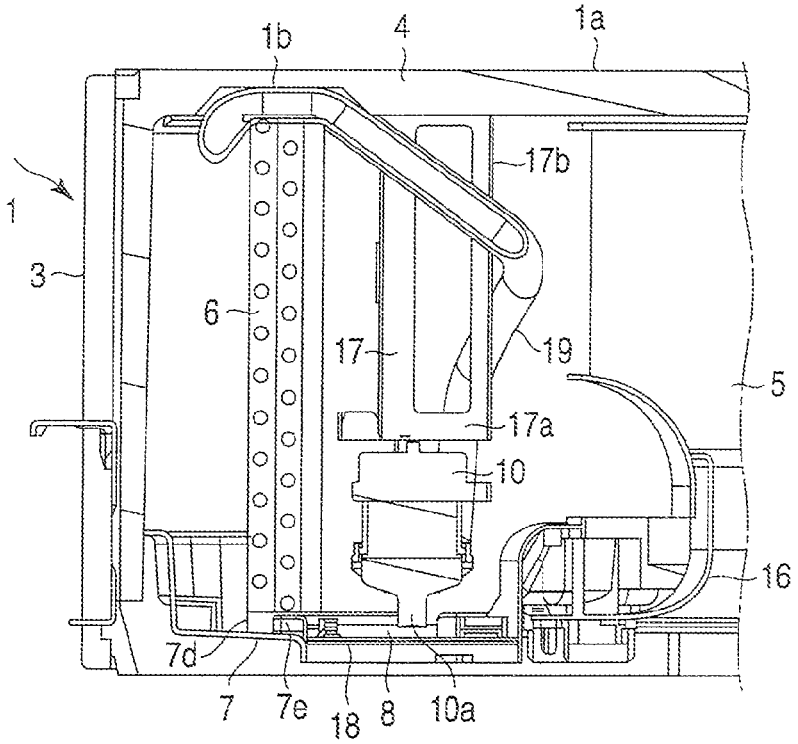
FIG. 4 is a sectional view of a part of the indoor unit according to the present embodiment.
Figure 5:
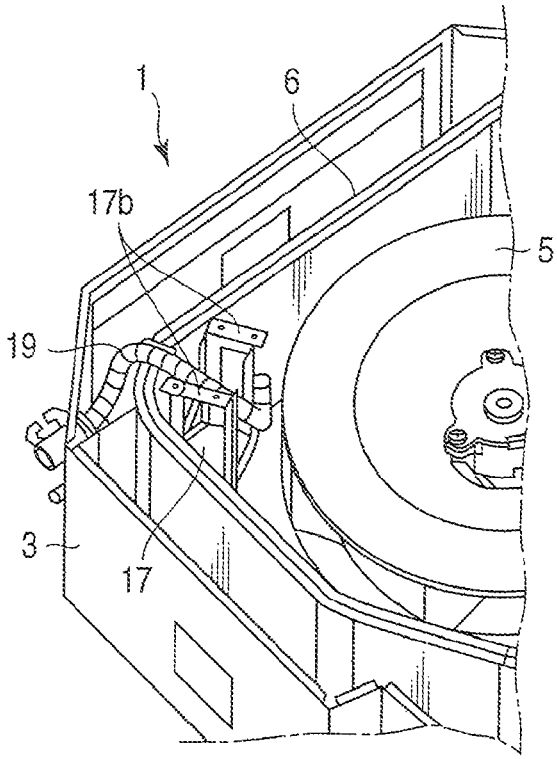
FIG. 5 is a view illustrating an inner structure of a part of the indoor unit according to the present embodiment.

FIG. 4 is a schematic structural view of a part of the indoor unit illustrating the configuration of attaching the drain pump 10. FIG. 5 is a perspective view of a part of the indoor unit illustrating the structure of attaching the drain pump 10 while exposing the inside by eliminating the ceiling board portion 1*a* of the indoor unit body 1.

The drain pump 10 is attached to a pump support 17 at the upper end face thereof while an intake portion 10*a* is directed to the drain port 8 which is to be the lower side. In a state that the drain cap 18 is fitted to the drain port 8, the clearance between the end face of the intake portion 10*a* of the drain pump 10 and the drain cap 18 is only extremely slight. An approximately half of the drain pump 10 at the lower side is located within the drain pan 7.

That is, the drain pump 10 is supported so that the intake portion 10*a* is completely immersed in the drain water accumulated in the drain pan 7. The pump support 17 which supports the drain pump 10 comprises a leg portion 17*b* extending right upward from a pump support portion 17*a*. The upper end of the leg portion 17*b* is attached and fixed to the ceiling board portion 1*a* which constitutes the indoor unit body 1.

A discharge portion which discharges the drain water sucked from the intake portion 10*a* is disposed at the back face side of the drain pump 10 illustrated in FIG. 4. Then, an end portion of a drain hose 19 is connected to the discharge portion. The drain hose 19 is wound between the leg portions 17*b* of the pump support 17 from the discharge portion, and further, is routed through the space between the upper end portion of the heat exchanger 6 and the ceiling board portion 1*a* of the indoor unit body 1.

That is, the ceiling board portion 1*a* of the indoor unit body 1 comprises a concave portion 1*b* where a part of the heat insulating material 4 attached to the inner face of the casing 3 is concavely formed. The drain hose 19 is inserted to the concave portion 1*b*.

Here, processing for the heat insulation material 4 is required. However, since it is simply to form the concave portion 1*b*, there is little effect on work time. Meanwhile, since no process is required for the upper end portion of the heat exchanger 6, there is no effect on work time.

In particular, as illustrated in FIG. 4, the heat exchanger 6 is mounted, at the lower end face thereof, on a jetty portion 7*d* which is integrally formed at the bottom face wall of the drain pan 7. Meanwhile, the upper end face of the heat exchanger 6 is in contact with the heat insulating material 4 which is disposed at the ceiling board portion 1*a* of the indoor unit body 1. That is, the heat exchanger 6 is vertically sandwiched and fixed between the ceiling board portion 1*a* of the indoor unit body 1 and the drain pan 7.

In the drain pan 7, when the jetty portion 7*d* which supports the heat exchanger 6 is formed along the entire circumference of the bottom face wall of the drain pan 7, the drain water generated at the heat exchanger 6 is separated into the inner side and the outer side of the jetty portion 7*d*. Here, the drain port 8 and the drain pump 10 are located at the inner side of the heat exchanger 6.

The drain water generated at the heat exchanger 6 and flowed to be accumulated at the inner side of the jetty portion 7*d* is guided directly to the drain port 8 and the drain pump 10. However, the drain water accumulated at the outer side of the jetty portion 7*d* remains thereat and is not guided to the drain port 8 and the drain pump 10 unless overflowing above the jetty portion 7*d*.

Accordingly, at least at one part of the jetty portion 7*d*, the jetty portion 7*d* is processed to form a cutout of some extent of length. That is, the jetty portion 7*d* is discontinued and the bottom face wall of the drain pan 7 appears at this discontinued portion 7*e*. Accordingly, the drain water flowing down to the outer side of the jetty portion 7*d* from the heat exchanger 6 is guided to the inner side via the discontinued portion 7*e*, and then, is to be discharged from the drain port 8 or the drain pump 10.

Next, the drain port 8 and the drain cap 18 will be described in detail.

Figure 6:
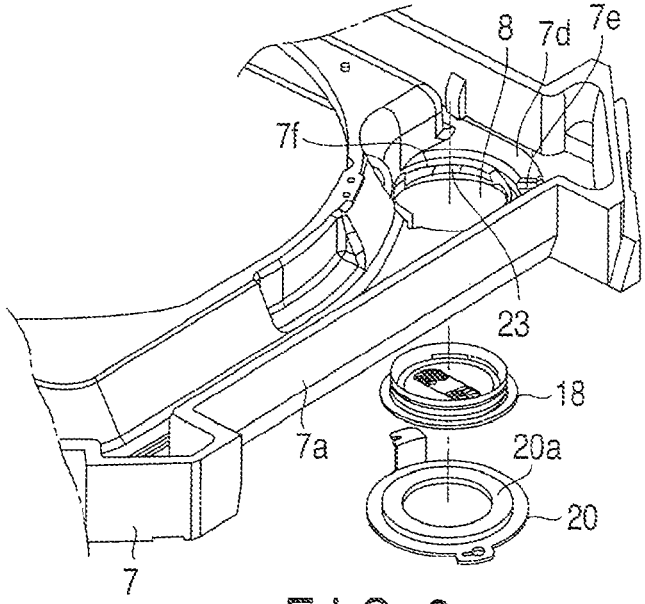
FIG. 6 is a perspective view in a state that a drain cap and an external cover are disassembled from a drain port of a drain pan according to the present embodiment.
Figure 7A:
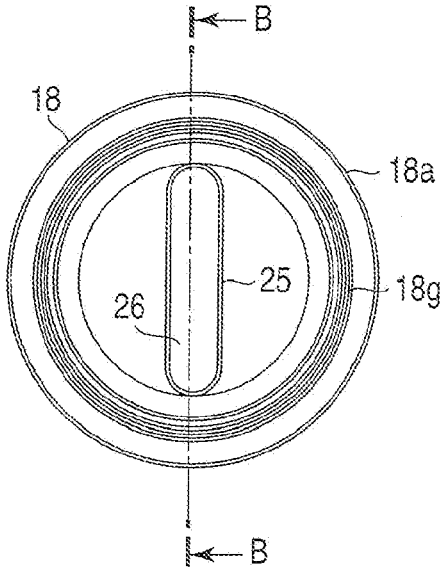
FIG. 7A is a front view of the drain cap according to the present embodiment.
Figure 7B:
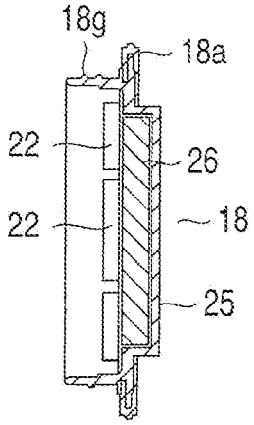
FIG. 7B is a sectional view along line B-B of the drain cap according to the present embodiment.

FIG. 6 is a perspective view in a state that the drain cap 18 and an external cover 20 are detached from the drain port 8. FIG. 7A is a front view of the drain cap 18. FIG. 7B is a sectional view along line B-B of the drain cap 18.

The drain port 8 formed at the drain pan 7 is provided integrally with a projecting portion downward along the circumference thereof. A female thread portion 7*f* is formed at the inner circumferential face of the projecting portion. Meanwhile, the drain cap 18 comprises a flange portion 18*a* shaped circular having a larger diameter than the diameter of the drain port 8 and a male thread portion 18*g* which is projected at one side face of the flange portion 18*a* and formed at the outer circumferential face thereof to be capable of being screwed with the female thread portion 7*f*.

Accordingly, by screwing and fastening the male thread portion 18*g* of the drain cap 18 to the female thread portion 7*f* of the drain port 8, the drain port 8 is closed with the drain cap 18. In this manner, so-called screw-cap structure is adopted, so that reliable closing operation without water leakage can be performed. In addition, by unscrewing and detaching the drain cap 18 from the drain port 8, the drain port 8 can be completely opened.

Further, a plurality of water drain holes 22 are arranged along the circumferential direction being apart to each other at the male thread portion 18*g* of the drain cap 18. A water drain groove 23 which is opened to be approximately the same dimension as or smaller dimension than that of the water drain hole 22 is arranged at one section of the female thread portion 7*f* of the drain port 8.

The water drain groove 23 of the drain port 8 is not communicated with the water drain hole 22 at the position where the drain port 8 is completely closed with the drain cap 18. When the drain cap 18 is rotated to release the complete closing of the drain port 8 and is opened to some extent, the water drain hole 22 is communicated with the water drain groove 23. Accordingly, the drain water in the drain pan 7 is discharged via the water drain hole 22 and the water drain groove 23.

Assuming the configuration of simply opening and closing the drain port 8 with the drain cap 18 without disposing the water drain hole 22 or the water drain groove 23, a large amount of drain water is instantly discharged from the drain port 8 when the drain cap 18 is detached from the drain port 8. Accordingly, there is a fear that the drain water is not sufficiently received and wets the vicinity. However, with the above-mentioned configuration, due to gradual discharging, all of the drain water can be received and the vicinity does not get wet.

In particular, as illustrated in FIGS. 7A and 7B in detail, a handle portion 25 projecting downward at the front face and being concavely formed at the back face is integrally disposed on the flange portion 18*a* of the drain cap 18. Accordingly, when the drain cap 18 is attached to or detached from the drain port 8, the operation can be easily performed by simply urging to rotate the drain cap 18 while grasping the handle portion 25.

Further, the concave portion is integrally formed at the back face side of the handle portion 25 and an antimicrobial material 26 is attached to the concave portion. The back face side of the drain cap 18 is immersed in the drain water accumulated in the drain pan 7 in a state that the drain port 8 is closed with the drain cap 18. Therefore, when long time passes while the drain water is accumulated in the drain pan 7, saprophytic bacteria are deposited at the drain cap 18 and the vicinity of the drain port 8, easily causing generation of scale and odor.

Here, by attaching the antimicrobial material 26 to the back face side of the drain cap 18, propagation of the saprophytic bacteria and the like at the drain cap 18 and the vicinity of the drain port 8 is suppressed so that causes of generating scale and order are eliminated. Since the drain water is to be cleaned, propagation of the saprophytic bacteria is suppressed at the entire drain pan 7. Accordingly, causes of clogging at the drain pump 10 and the drain hose 19 are eliminated.

Referring back to FIG. 6, the drain cap 18 is covered with the external cover 20 which is detachably attached to the lower side. Therefore, the drain cap 18 cannot be seen in a normal state. That is, the external cover 20 which is formed of the same material and of the same color as the decorative panel 2 covers the end opening of the projecting portion where the female thread portion 7*f* of the drain port 8 is disposed, in a manner of being capable of opening and closing.

Further, the external cover 20 comprises a circular concave portion 20*a* projecting to the back face side (i.e., upward). The outer diameter dimension of the circular concave portion 20*a* is the same as the diameter dimension of the drain port 8. Therefore, the external cover 20 can be fixed as being hung at the circular concave portion 20*a* to the projecting portion end with a single motion. When detaching the external cover 20, it can be easily performed by grasping and pulling down the circular concave portion 20*a*.

In short, the drain cap 18 is to be an inner cover for the drain port 8, and then, the external cover 20 which is to be an outer cover is attached to the lower side. In this manner, such double structure is adopted. The clearance of some extent is formed between the external cover 20 and the drain pan 7, so that an air layer is provided.

Accordingly, even when temperature of the drain water accumulated in the drain pan 7 is low and the drain cap 18 is cooled, moisture condensation does not occur at the lower face of the drain cap 18 due to existence of the air layer. In a case only with the drain cap 18 without the external cover 20, moisture condensation occurs at the lower face of the drain cap 18 and drips directly drop to the room. Accordingly, there is a fear that the room gets wet. By disposing the external cover 20, the moisture condensation at the lower face of the drain cap 18 can be prevented so that the drip dropping to the room can be prevented.

In the indoor unit of a ceiling-embedded air conditioner as structured as described above, when the blower 5 is driven, room air is sucked into the indoor unit body 1 while being guided by the bell mouth 16 via the intake grille 13 and the intake port 12. The room air is circulated within the heat exchanger 6 from the primary side of the heat exchanger 6 and is introduced to the secondary side after being heat-exchanged.

Then, the heat-exchanged air is blown out from the blowing port 15 and air conditioning in the room is performed. In particular, at the time of cooling operation, drain water is generated along with heat exchange operation of the heat exchanger 6 and drops to the drain pan 7. With passage of time, the accumulated amount of the drain water in the drain pan 7 is increased and the water level is heightened.

When the water level of the drain water is detected to exceed the maximum reference water level while continuously detecting the water level of the drain water in the drain pan 7 by a float switch, the float switch transmits a detection signal to a controller. The controller transmits a drive signal to the drain pump 10, so that the drain pump 10 sucks the drain water and discharges to the outside via the drain hose 19.

The drain water accumulated in the drain pan 7 is smoothly discharged without overflowing above the drain pan 7. When the float switch detects that the water level of the drain water is lowered to the minimum reference water level while being gradually lowered, a detection signal is transmitted to the controller again. The controller transmits a stop signal to the drain pump 10, so that discharging of the drain water is stopped.

At the time of maintenance operation and the like, in order to discharge all of the drain water remaining in the drain pan 7, the external cover 20 and the drain cap 18 are detached from the drain port 8.

Figure 8A:
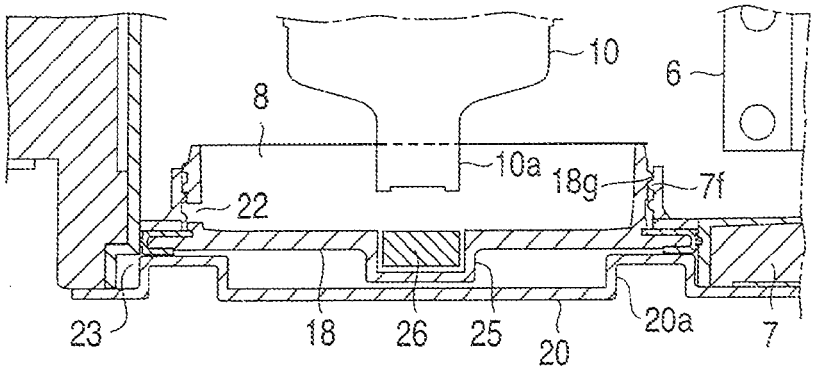
FIG. 8A is an explanatory view for illustrating operation to sequentially detach the external cover and the drain cap from the drain port according to the present embodiment.
Figure 8B:
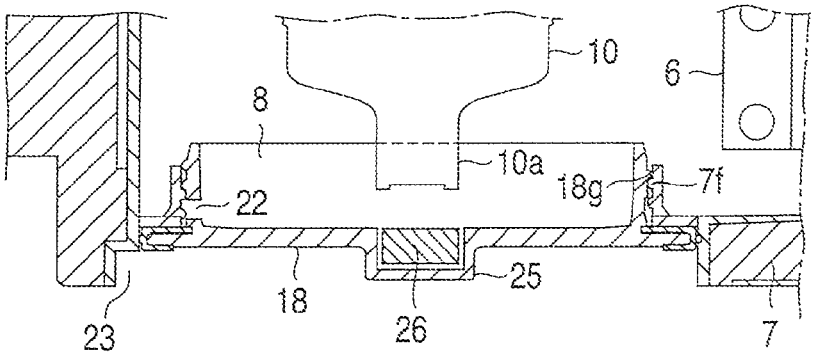
FIG. 8B is an explanatory view for illustrating operation to sequentially detach the external cover and the drain cap from the drain port according to the present embodiment.
Figure 8C:
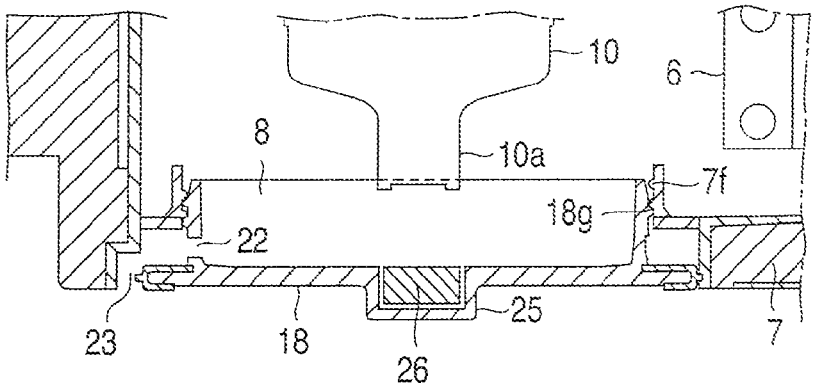
FIG. 8C is an explanatory view for illustrating operation to sequentially detach the external cover and the drain cap from the drain port according to the present embodiment.

FIGS. 8A, 8B and 8C are explanatory views which sequentially illustrate the states of detaching the external cover 20 and the drain cap 18 from the drain port 8.

In FIG. 8A, the drain cap 18 and the external cover 20 are attached to the drain port 8 and the drain port 8 is closed. That is, the male thread portion 18*g* of the drain cap 18 is screwed and fastened with the female thread portion 7*f* of the drain port 8. The intake portion 10*a* of the drain pump 10 is inserted to the inner diameter side of the male thread portion 18*g* of the drain cap 18 and is located at a position where the drain water in the drain pan 7 is reliably sucked.

At that time, the water drain hole 22 disposed at the male thread portion 18*g* of the drain cap 18 is located at a position which is not opposed to the water drain groove 23 disposed at the female thread portion 7*f* of the drain port 8. Accordingly, since the water drain hole 22 is closed by the projecting portion which is integrally formed at the circumferential face of the drain port 8, the drain water is not discharged from the water drain hole 22.

The antimicrobial material 26 filled in the concave portion at the back face of the handle portion 25 of the drain cap 18 is reliably immersed into the drain water. The external cover 20 is fitted to the projecting portion end of the drain port 8 and covers the drain cap 18, so that the air layer is formed between the drain cap 18 and the external cover 20. Accordingly, even if the drain water is cold and the drain cap 18 is cooled, moisture condensation does not occur at the lower face thereof.

In the maintenance operation of the drain pump 10, it is necessary to discharge the drain water accumulated in the drain pan 7 by opening the drain port 8. First, as illustrated in FIG. 8B, the external cover 20 is detached, so that the drain cap 18 is exposed. In this state, the water drain hole 22 disposed at the male thread portion 18*g* of the drain cap 18 is located at a position which is not opposed to the water drain groove 23 disposed at the female thread portion 7*f* of the drain port 8. Since the water drain hole 22 is closed with the projecting portion, the drain water is not discharged from the water drain hole 22.

Next, the handle portion 25 of the drain cap 18 is grasped and operated to rotate in the direction to release screwed connection between the female thread portion 7*f* and the male thread portion 18*g*. When the drain cap 18 is further urged to rotate after the closing state of the drain cap 18 against the drain port 8 is loosened, a part of the water drain hole 22 disposed at the male thread portion 18*g* of the drain cap 18 is communicated with the water drain groove 23 disposed at the female thread portion 7*f* of the drain port 8 as illustrated in FIG. 8C.

The drain water accumulated in the drain pan 7 is discharged from the drain port 8 via the water drain groove 23 and the water drain hole 22. Since the discharge amount of the drain water is increased as the communication area of the water drain hole 22 with the water drain groove 23 is increased, the discharge amount is simply adjusted in an appropriate manner.

When the drain water is completely discharged from the drain pan 7, the drain cap 18 is detached from the drain port 8. Consequently, the operation to discharge the drain water can be reliably performed without wetting the vicinity thereof. By completely opening the drain port 8, the drain pump 10 can be seen through the drain port 8 as previously illustrated in FIGS. 1 and 2.

Since the drain pump 10 is formed so that the diameter thereof is smaller than that of the drain port 8, there is clearance of some extent between the circumferential face of the drain pump 10 and the circumferential face of the drain port 8. Then, fixtures which have attached the drain pump 10 to the pump support 17 are removed by inserting a tool to the clearance. The drain pump 10 is prevented from dropping by supporting with a hand not grasping the tool until all of the fixtures are removed.

When all of the fixtures are removed, the drain pump 10 is lowered along the center axis thereof. The drain pump 10 is separated from the pump support 17 and is passed through the drain port 8 accordingly, so that the drain pump 10 can be detached from the indoor unit body 1. Therefore, the maintenance of the drain pump 10 can be performed on any portion thereof.

As described above, the drain pump 10 is attached to the primary side of the heat exchanger 6 which is a heat exchange air introducing side of the heat exchanger 6. With this configuration, when the intake port 12 is exposed by opening the intake grille 13 of the decorative panel 2, the drain pump 10 can be detached via the intake port 12. Specifically, it is not necessary to detach the decorative panel 2, the drain pan 7 or the electric part box 11. Therefore, operability is improved and special processing for the heat exchanger 6 becomes unnecessary, contributing to work time reduction.

Here, a DC motor is adopted for a motor which constitutes the drain pump 10. A DC motor has a feature of low vibration compared to an AC motor which is generally used in the related art.

In further description, an AC motor used for a drain pump in the related art has some vibration. The vibration of the AC motor is transmitted to the indoor unit body 1 and apt to be leaked as operational noise into the room which is the outside of the indoor unit body 1. Accordingly, the drain pump 10 has been attached to the indoor unit body 1 with a metal-made bracket, damping rubber, and another metal-made bracket for height adjustment.

By adopting such a vibration absorption structure, specific effects can be obtained. However, the structure of attaching the drain pump 10 is complicated and a large space is occupied within the indoor unit body 1. Further, since the drain pump 10 and the structure of attaching it cause the ventilation resistance, the performance of the air conditioner is affected.

Figure 9A:
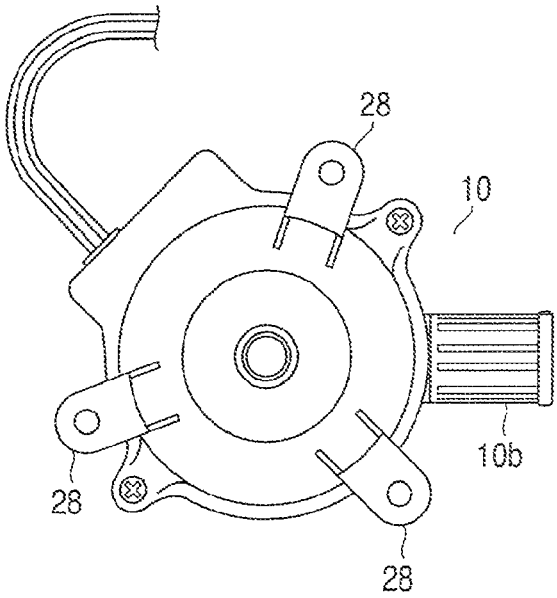
FIG. 9A is a plane view of a drain pump according to the present embodiment.
Figure 9B:
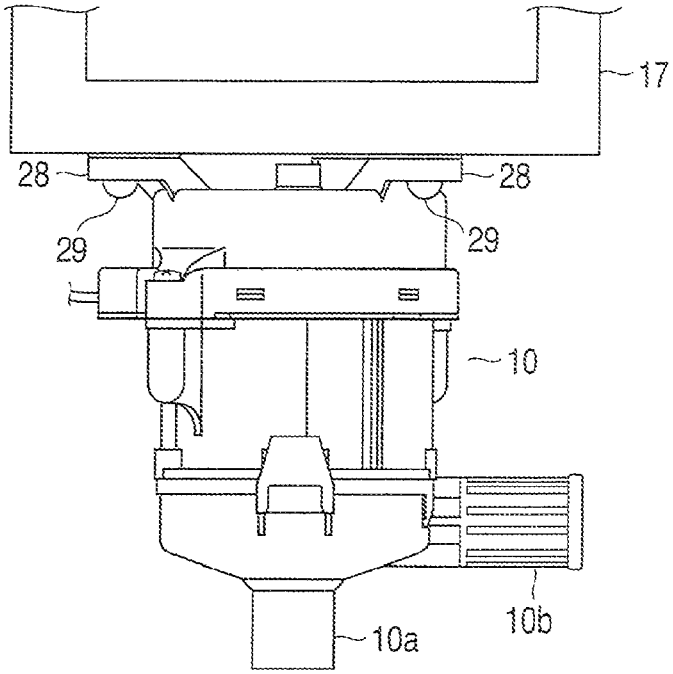
FIG. 9B is a front view of the drain pump which is supported by a pump support according to the present embodiment.

FIG. 9A is a bottom view of the drain pump 10 which is used for the present invention. FIG. 9B is a front view of the drain pump 10 which is attached to and supported by the pump support 17. Here, in FIGS. 9A and 9B, a discharge portion 10*b* is connected to the above-mentioned drain hose 19 of FIGS. 4 and 5.

Since a DC motor is used, the drain pump 10 of the present invention decreases vibration. Accordingly, the drain pump 10 can be directly attached to the indoor unit body 1. Specifically, a flange portion 28 for attaching is disposed at the upper face section of the drain pump 10. The flange portion 28 for attaching is attached and fixed to the pump support 17 via fixtures 29. Accordingly, special brackets and damping rubber of the related art become unnecessary.

Here, although not illustrated in particular, it is also possible that the flange portion for attaching to the pump support is disposed at the side face section of the drain pump 10 and the pump support is attached to the side face section of the indoor unit body 1. That is, since the drain pump 10 itself is lightened by adopting a DC motor, the drain pump 10 can be attached to the side face section of the indoor unit body 1.

Figure 10:
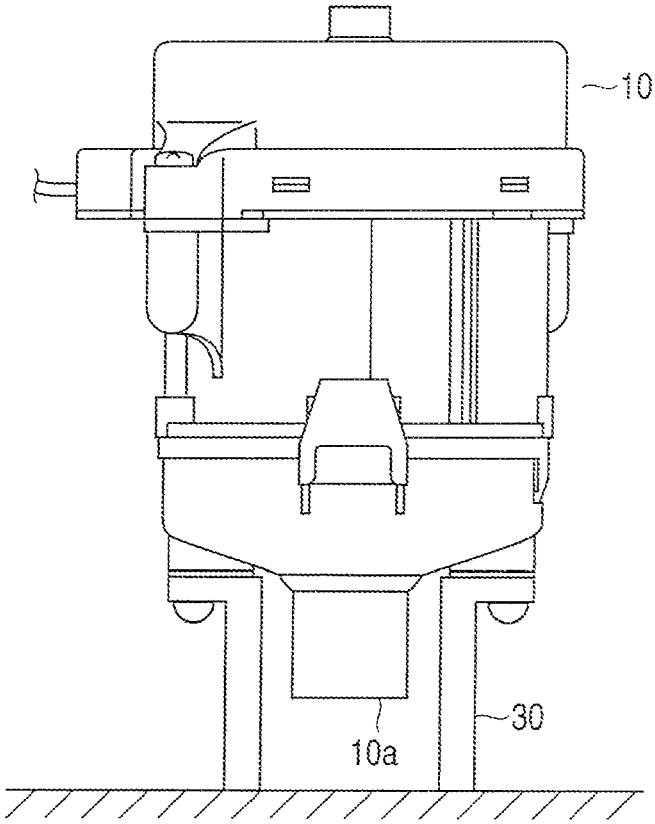
FIG. 10 is a front view of the drain pump which is supported by a pump support according to a modified example of the present embodiment.

FIG. 10 is a front view of a state that the lower face section of the drain pump 10 is supported by a pump support 30. By adopting a DC motor for the drain pump 10, the drain pump 10 can be lightened and can be directly attached to the lower face section.

That is, the pump support 30 for lower face attaching is disposed at the lower face section of the drain pump 10. Accordingly, location restriction to the upper face and side face of the drain pump 10 against the indoor unit body 1 is eliminated. Due to the elimination of the location restriction, ventilation resistance against the heat exchange air is decreased. In this manner, by adopting the pump support 30, the drain pump 10 receives less restriction of attaching location to the indoor unit body 1 and can be arranged relatively freely.

Here, the present invention is not simply limited to the above-mentioned embodiments. In a practical stage, the present invention can be actualized by modifying structural elements without departing from the scope of the invention. In addition, by appropriately combining a plurality of structural elements disclosed in the above-mentioned embodiments, a variety of inventions can be actualized.

According to the present invention, effects such as contributing to work time reduction can be obtained due to elimination of special processing for a heat exchanger while easing maintenance operation for a drain pump.

What is claimed is:

1. An indoor unit of an air conditioner, comprising:

an indoor unit body which is a housing whose lower face is opened;

a blower configured to draw air from an axis direction and blow the air in a circumferential direction, the blower being arranged to be opposed to an approximately center part of the opened lower face;

a heat exchanger which is arranged to surround a circumference of a blowing side of the blower;

a drain pan which is disposed below the heat exchanger and configured to receive drain water generated at the heat exchanger, the blower, the heat exchanger and the drain pan being accommodated inside the indoor unit body;

a decorative panel which closes the lower face opening portion of the indoor unit body and comprises an intake port being opposed to the blower and the inside of the heat exchanger and a blowing port being opposed to a space between an outer portion of the heat exchanger and a side wall of the indoor unit body;

a drain pump configured to draw drain water accumulated in the drain pan and discharge the drain water to the outside, the drain pump being arranged at a position above at least a part of the drain pan and above the intake port of the decorative panel;

a drain pump insertion port having a diameter wherein the drain pump is inserted and removed from the indoor unit through the drain pump insertion port, the drain pump insertion port being arranged at a drain pan bottom face wall section below the drain pump, the drain pump insertion port comprising a female thread portion at a circumferential face thereof;

a closing member which is removably attached to the drain pump insertion port, the closing member comprising a male thread portion at a circumferential face thereof, the male thread portion being screwed into the drain pump insertion port to be fixed thereon;

a water drain hole disposed at the male thread portion of the closing member; and a water drain groove disposed at the female thread portion of the drain pump insertion port, the water drain groove configured to communicate with the water drain hole during opening of the closing member and discharge drain water in the drain pan therethrough, the water drain groove being opened to be approximately a same or smaller area than an area of the water drain hole.

2. The indoor unit of an air conditioner according to claim 1, wherein the closing member comprises a handle portion formed in a projected manner of which a back face comprises a concave portion, and an antimicrobial material attached to the concave portion of the back face of the handle portion.

3. The indoor unit of an air conditioner according to claim 2, wherein the closing member is covered at the lower side thereof with an external cover which is detachably attached to the decorative panel.

* * * * *